US006634045B1

(12) United States Patent
DuDonis et al.

(10) Patent No.: US 6,634,045 B1
(45) Date of Patent: Oct. 21, 2003

(54) HEEL ELEVATOR SUPPORT

(76) Inventors: Matt DuDonis, 9141 Gracious End Ct., Columbia, MD (US) 21046-2095; Leslie Rowan, 2910 Fessenden St. NW., Washington, DC (US) 20008

( * ) Notice: Subject to any disclaimer, the term of this patent is extended or adjusted under 35 U.S.C. 154(b) by 0 days.

(21) Appl. No.: 10/113,355

(22) Filed: Apr. 1, 2002

(51) Int. Cl.[7] ..... A47C 20/00; A61G 7/075

(52) U.S. Cl. ..... 5/648; 5/650; 5/632

(58) Field of Search ..... 5/648, 650, 624, 5/630, 632, 732; 128/882

(56) References Cited

U.S. PATENT DOCUMENTS

| | | | | | |
|---|---|---|---|---|---|
| 2,709,435 | A | | 5/1955 | Kress | |
| 3,333,286 | A | | 8/1967 | Biolik | |
| 3,389,411 | A | * | 6/1968 | Emery | 5/490 |
| 3,639,927 | A | | 2/1972 | Munch | |
| 3,842,977 | A | | 10/1974 | Hollander | |
| 4,054,204 | A | | 10/1977 | Keeton | |
| 4,071,031 | A | * | 1/1978 | Lowman | 607/114 |
| 4,711,067 | A | | 12/1987 | Magni | |
| 4,928,337 | A | * | 5/1990 | Chauncey | 5/722 |
| D311,470 | S | | 10/1990 | Cosgrove | |
| 5,134,739 | A | | 8/1992 | Gaffe | |
| 5,173,979 | A | | 12/1992 | Nennhaus | |
| 5,289,828 | A | | 3/1994 | Toth | |
| 5,477,866 | A | * | 12/1995 | Davenport | 5/648 |
| 5,584,303 | A | | 12/1996 | Walle | |
| 5,603,284 | A | * | 2/1997 | Freedman | 119/28.5 |
| 5,666,682 | A | | 9/1997 | Bonaddio | |
| 5,745,939 | A | | 5/1998 | Flick | |
| 5,878,551 | A | | 3/1999 | Curley | |
| 5,944,683 | A | | 8/1999 | Baranowski | |
| 5,997,491 | A | * | 12/1999 | Harris | 602/6 |
| 6,065,166 | A | | 5/2000 | Sharrock | |
| 6,085,371 | A | | 7/2000 | Umhofer | |
| 6,135,560 | A | | 10/2000 | Fagg | |
| 6,151,739 | A | | 11/2000 | Meyer | |
| 6,175,979 | B1 | | 1/2001 | Jackson | |
| 6,186,967 | B1 | | 2/2001 | Messina | |
| 6,256,804 | B1 | | 7/2001 | Stevens | |
| 6,260,221 | B1 | * | 7/2001 | Grabell et al. | 5/648 |
| 6,442,779 | B1 | * | 9/2002 | LeVert et al. | 5/648 |

OTHER PUBLICATIONS

U.S. Department of Health and Human Services, Treatment of Pressure Ulcers,1994, AHCPR Publication No. 95–0652, Public Health Service, Agency for Health Care Policy and Research, Rockville, Maryland.

* cited by examiner

*Primary Examiner*—Michael F. Trettel
(74) *Attorney, Agent, or Firm*—William S. Ramsey

(57) ABSTRACT

A heel elevating foam cushion is used to relieve heel pressure ulcers in patients confined to bed. The cushion elevates the lower legs and thereby supports the feet without any contact with the feet. Bolsters or palisades on either side of the cushion prevent the legs from falling from the bed, while allowing normal movement of the legs associated with cleaning of the patient, medical treatment of the limbs, etc. The surface of the cushion is covered by a waterproof covering. The cushion may be in a single use or multiple use configuration. A compression process is used to reduce the volume of the cushion by a factor of approximately eight, thereby allowing the convenient storage of cushions without the requirement for extensive storage facilities. The cushion finds application in treating persons with heel or foot pressure ulcers, in treatment of persons after orthopedic surgery, and in recovery from venous surgery for insufficient circulation in the lower limbs.

33 Claims, 12 Drawing Sheets

HEEL ELEVATOR SUPPORT

CROSS-REFERENCE TO RELATED APPLICATIONS

Not Applicable.

FEDERALLY SPONSORED RESEARCH

Not Applicable.

SEQUENCE LISTING OR PROGRAM

Not Applicable.

BACKGROUND OF THE INVENTION

1. Field of Invention

This invention relates to supports which elevate the lower legs of patients with circulatory insufficiency in the lower limbs in order to prevent or relieve pressure ulcers on the heels or feet.

2. Description of Related Art

The incidence of pressure ulcers is sufficiently high as to warrant concern among health care providers. High-risk groups include elderly patients admitted to a hospital for femoral fracture and critical care patients. The prevalence of pressure ulcers in skilled care facilities and nursing homes is reported to be as high as 23 percent.

Successful management of pressure ulcers involves three components; nutritional assessment and support; management of tissue loads; and managing bacterial colonization and infection.

Management of tissue loads, i.e. pressure, friction, and shear, through use of positioning techniques and support surfaces is critical to the treatment of pressure ulcers. It is important that individuals with pressure ulcers who are in bed not be positioned on the pressure ulcers. Positioning devices should be used to raise a heel ulcer off the support service and prevent direct contact between bony prominences. Care should be taken to assure that the patient has not "bottomed out" under a pressure ulcer or part of the body at risk for ulcer formation, that is, that there should be at least one inch of support material below that portion of the body.

Because of the small surface area it is difficult to redistribute pressure under the heels and new pressure ulcers often develop on the heels of patients cared for on pressure-reducing devices. Suspension of the heel has been suggested as the best remedy, especially in individuals unable to reposition their lower extremities. Ring cushions have been found to be more likely to cause pressure ulcers than to prevent them. Treatment of Pressure Ulcers, Clinical Guideline Number 15, AHCPR Publication No. 95-0625, December 1994.

The present invention deals with the prevention and management of heel pressure ulcers primarily in two ways. 1. It raises the lower legs with respect to the torso and thereby promotes the circulation of blood through the legs and feet. 2. It suspends the heels and feet above and out of contact with any support surface, thereby preventing the development of pressure ulcers and encouraging the healing of existing pressure ulcers. The present invention also finds additional application in treating post-operative orthopedic patients, and in pre- or post-operative patients with venous insufficiency.

U.S. Pat. No. 2,709,435 discloses a leg rest which supports a leg for the purpose of treating the leg with medical fluids and for collecting the fluids which drain from the leg.

U.S. Pat. No. 3,333,286 discloses an adjustable sick-bed bolster which is wedge shaped and capable of multiple configurations. The bolster can be made of foam rubber or any similar material.

U.S. Pat. No. 3,639,927 discloses a mattress for invalids in which two wedge pieces support the shanks down to the region of the ankles. The heels and feet do not contact the mattress.

U.S. Pat. No. 3,842,977 discloses a pillow-enclosing casing in which a pillow, particularly a foam pillow, is rolled and reduced in volume and then inserted into a tubular casing.

U.S. Pat. No. 4,045,204 discloses a compressed foam article which is compressed and packaged by enclosure in a substantially air-tight sack and a vacuum is drawn in the sack.

U.S. Pat. No. 4,711,067 discloses a method of packaging a mattress to a small size, in which the mattress is squeezed by compression means which drive the air from mattress and is then placed in a closed container or case.

U.S. Pat. No. 5,134,739 discloses a protective device which gives a set position to lower limbs. This involves a central block with side supports for the legs which have a concave shape.

The heels and feet do not touch the device. This device does include provisions for preventing the legs from falling off the device.

U.S. Pat. No. 5,173,979 discloses an inflatable leg and foot supporting cushion. The heels are supported by the cushion. The cushion is covered by a fluid-impermeable material. The cushion may include a lip or be covered with a diaper-like material to contend with fluids from ulcers.

U.S. Pat. No. 5,289,828 discloses a pillow for orthopedic support, especially for support after hip surgery.

U.S. Pat. No. 5,584,303 discloses a therapeutic leg elevator which supports the leg from the ankle to at least the calf which can be configured so that the heel does not contact the foot portion of the support.

U.S. Pat. No. 5,666,682 discloses a foam mattress pad of adjustable width which has a tear strip of foam material to reduce the width of the mattress.

U.S. Pat. No. 5,745,939 discloses a leg rest for supporting a patient on a bed during turning or otherwise managing the patient. There are a pair of trough portions for receiving the patient's legs and which prevent movement of the patient's legs.

U.S. Pat. No. 5,878,551 discloses method of packaging a foam pet industry product which involves placing the foam product inside a plastic bag, reducing the pressure to remove fir from the bag, and sealing the bag.

U.S. Pat. No. 5,944,683 discloses a resilient cushion to be positioned on the skin adjacent a bony prominence having a recess for the bony prominence.

U.S. Pat. No. 6,065,166 discloses an inflatable surgical support cushion which includes a concavity formed by side bolster structures.

U.S. Pat. No. 6,085,371 discloses a leg support apparatus which supports a single leg and is made from cardboard, plastics, or wire frames, and are stack able or foldable.

U.S. Pat. No. 6,135,560 discloses a travel headrest pillow shaped to conform to the shape formed by the back of the user's neck, head and shoulder.

U.S. Pat. No. 6,151,739 discloses a sleep support surface including a mattress with inflatable bladders near the foot end which lift the calves of the patient and reduce pressure on the patient's heels.

U.S. Pat. No. 6,175,979 discloses an inflatable orthopedic pillow with an area for isolating a patient's foot as well as provisions for maintaining the foot in a particular position or orientation.

U.S. Pat. No. 6,186,967 discloses a elevation support for a limb which surrounds a limb and has a longitudinal aperture for insertion at least a portion of the limb.

U.S. Pat. No. 6,256,804 discloses a pillow like protector and support device with a central surface having cut-away air gaps forming grooves for supporting various body parts.

U.S. Pat. No. 6,260,221 discloses a heel supporting apparatus which substantially immobilizes the legs and includes a heel pad which supports the heel and an inflatable bladder which contacts the bottom of the feet.

U.S. Pat. No. D311,470 discloses a support cushion with contours which supports a person's legs and feet.

None of the prior art devices have the characteristics of the present invention, that of elevating and supporting a patients heels and feet to prevent and manage pressure ulcers using an inexpensive cushion which is inexpensive, easy to manufacture and clean, and provides support for the legs while allowing reasonable movement associated with patient treatment.

BRIEF SUMMARY OF THE INVENTION

This application discloses a heel elevator support for stimulating circulation in the lower and upper extremities and for preventing and managing heel pressure ulcers. The invention comprises a rectangular cushion having a front end and a back end, a left and a right side, and a top and bottom surface, the cushion having a width from the left side to the right side approximating the width of a bed, approximately 26 to 36 inches. The cushion having a length from the front end to the back end approximating the length of a patient's leg from knee to Achilles tendon, approximately 12 to 25 inches. The cushion having from the top surface to the bottom surface a height adequate to stimulate circulation in the lower extremities, approximately 3–6 inches. Two ramparts are integral with the cushion, a first rampart located at the left side and parallel to the left side, and a second rampart located at the right side and parallel to the right side. Each rampart extends above the upper surface of the cushion approximately 1 to 8 inches. Examples of ramparts which are bolsters and palisades are disclosed. The support is comprised of a foam material, and the support is covered by a water-resistant elastomer material.

Pressure ulcers have become a multi million dollar largely preventable problem for the healthcare industry. The incidence of lawsuits due to patient injury has continued to increase exponentially, with the average settlement rising from $250,000 to $450,000 in the past two years. In areas that do not have caps for settlements, this figure has been in the millions of dollars. This is regarded as a sentinel injury.

Heel pressure ulcers in particular are a problem because, due to decreased blood flow, they do not heal quickly. Heel ulcers cause decreased mobility, considerable pain, and can lead to amputation in patients with severe arterial disease.

Venous stasis disease, predisposing to heel pressure ulcers, is a lifetime problem for some patients, necessitating continued control of edema in order to prevent recurrent skin breakdown. Many of these patients also have some degree of arterial insufficiency, which makes leg elevation painful. Because of these factors, noncompliance with prescribed treatment regimens to manage the disease is very high.

Orthopedic patients, particularly patients with lower extremity procedures such as hip surgery, and those with cases, are at extreme risk because of the immobility needed in the immediate post procedure period. Additional immobility sometimes occurs due to pain while in rehab. These patients can experience only the slightest degree of elevation, due to the need for proper joint positioning, which leads to a very high degree of heel pressure and risk of development of heel pressure ulcers. Any such heel injury can cause delays in rehab because of inability to walk on the injured foot or to put a shoe on the injured foot.

Any patient who requires extended periods (greater than 1–2 hours) of limb elevation would benefit from this invention, as it does not require constant repositioning or reapplication. This includes upper extremities, as may occur in patients with lympodema, which often accompanies mastectomy patients. In these cases maintaining proper blood flow to reduce swelling while minimizing pain or joint injury are key in the post operation period. The present invention provides minimum elevation under stable conditions, due to the use of high density foam.

Even the use of pressure relief beds has been shown to result in pressures as high as 25 mmHG on patient's heels. The present invention eliminates any pressure on the heel.

Elevation of extremities, upper as well as lower, allows increased venous flow without compromising arterial flow. This is particularly beneficial in the treatment and prevention of edema.

The present invention allows for proper positioning of extremities, while allowing for leg and foot mobility, which provides maximum comfort for any patient who must be in bed longer than 2 hours.

The present invention can be used for patients with bed immobility due to any disease process, venous stasis disease, including patients with mixed arterial insufficiency, orthopedic patients who require positioning and pressure ulcer prevention, and in general, any patient whose disease process would benefit from minimal extremity elevation.

The present invention does not require the use of boots. Boots can injure the patient through improper fit, pressure due to hook and loop straps, and the boot slipping into improper position. These problems can cause sever injury to the patient through decreased arterial flow and direct pressure on the skin. The use of boots requires removal and inspection every 2 hours to avoid these problems. The present invention avoids all of these difficulties.

The present invention avoids patient injury due to waffle type foam. Such foam can cause "indention" and pressure injury, particularly in patients with sever edema. Waffle boots have the additional disadvantage in that they cannot be adjusted to rotate pressure points on the calf and foot areas. Furthermore, after periods of time as little as 1 hour the foam in waffle boots can compress so the heel is no longer relieved of pressure, and, in fact, is in a pocket of increased pressure.

Because the present invention has minimal elevation and does not restrain the movement of the patient, it is especially suitable for use with patients having arterial disease. It avoids the pain associated with slings and other means of limb elevation in such patients. The present invention allows the patient to continue to have minimal unconstricted movement of the extremity, which provides increased comfort with no decrease in blood flow.

The use of high density foam in the present invention allows positioning of the patient at the recommended elevation of approximately 1 inch with support of the calf and knee. The average hospital pillow is not made of high density foam and is not suitable for this use. On the contrary, the average hospital pillow compresses under extremity pressure and does not keep the heel or upper extremity off the bed for extended periods of time.

The standard hospital wedge type pillow does not provide for the proper positioning of the present invention. A wedge type pillow is intended for upper torso elevation, and can constrict the knee area, which decreases circulation to the foot and calf area, causing discomfort and possible injury.

The object of this invention is to provide a support used to prevent development of heel and foot pressure ulcers in patients confined to bed.

Another objective is to provide a support with a waterproof coating which resists infiltration by wound exudate and allows easy cleaning of the cushion.

Another objective is to provide a support which elevates the legs with respect to the torso in order to improve circulation in the legs and feet.

Another objective is to provide a support which suspends the heels and feet without contact with a support surface to prevent the development of pressure ulcers or facilitate the management of existing pressure ulcers.

Another objective is to provide a support which prevents the patient's legs from falling from the edges of the cushion while allowing normal movement of the legs associated with patient management.

Another objective is to provide a support with an inlay of specialized support surface for patients at unusual risk of development of pressure ulcers in the lower extremities.

Another objective is to provide a support with a scalloped surface for accommodations of the lower extremities in patients where it is desirable to suppress movement of the lower extremities.

Another objective is to provide a support which can be packaged in a reduced volume in order to relieve the storage requirement for cushion inventory.

A final objective is to provide a support which is inexpensive, easy to manufacture, and capable of manufacture and use without adverse effect on the environment.

DETAILED DESCRIPTION OF THE INVENTION

Figure 1:
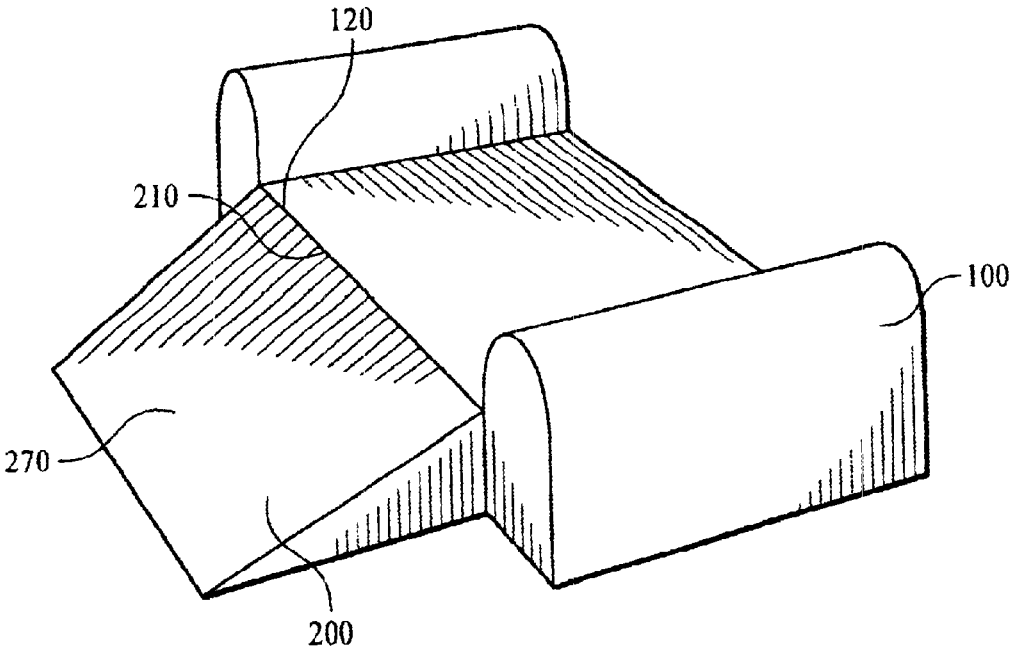
FIG. 1 shows a perspective view of the first embodiment heel elevator support and secondary heel elevator support.

FIG. 1 is a perspective view showing the relation between the first embodiment heel elevator support 100 and the supplemental support 200. The front end 210 of the supplemental support is adjacent to or touching the rear end 120 of the heel elevator support. The top surface 270 of the supplemental support is visible in FIG. 1. Dotted lines are used to indicate the location of the bottom surface, left side, and right side of the supplemental support.

Figure 2:
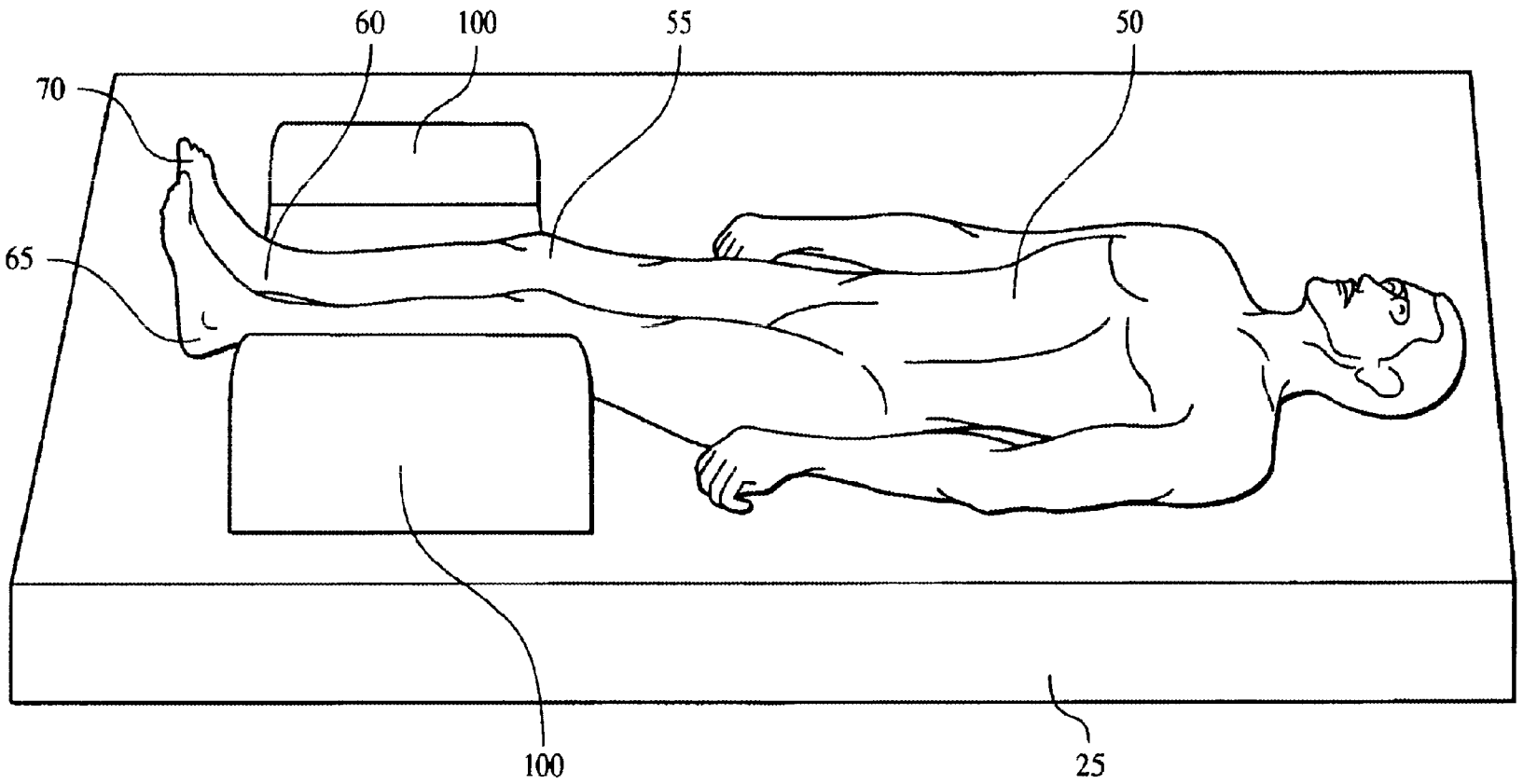
FIG. 2 shows a side view of the first embodiment heel elevator support and secondary heel elevator support in use.

FIG. 2 is a side view of the heel elevator support 100 in use by a patient 50. The patient and first embodiment heel elevator support are lying the upper surface of a mattress 25. The patient's legs below the knees 55 and above the Achilles tendon 60 are elevated and supported by the heel elevator support. Note especially that the heel 65 and foot 70 are suspended without contact with any surface.

Figure 3:
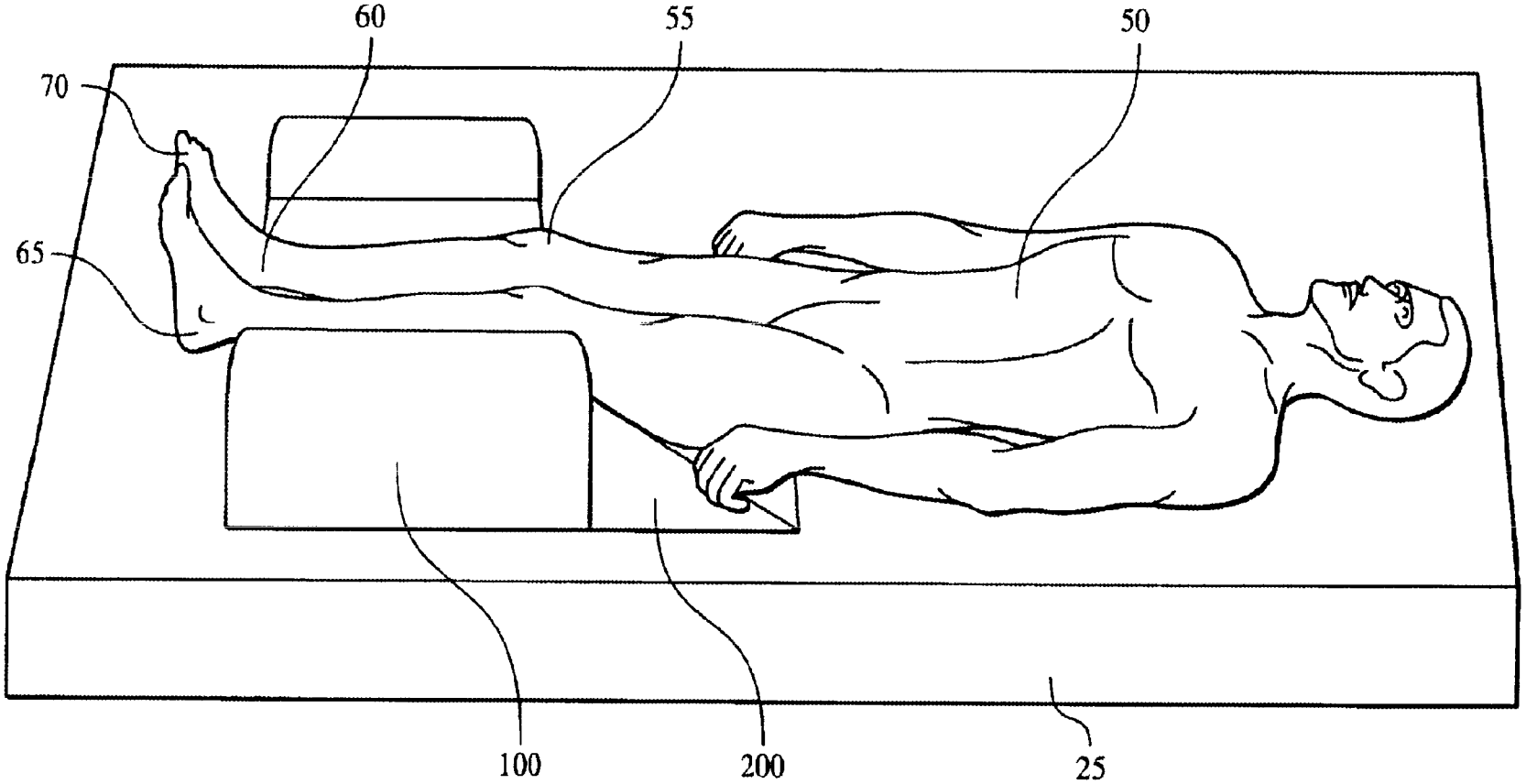
FIG. 3 shows a side view of the first embodiment heel elevator support in use.

FIG. 3 is a side view of the first embodiment heel elevator support 100 with the supplemental support 200 in use by a patient 50. FIG. 3 is identical to FIG. 2 except that the patient's legs from the hips 52 to the knees 55 are supported by the supplemental support 200.

Figure 4:
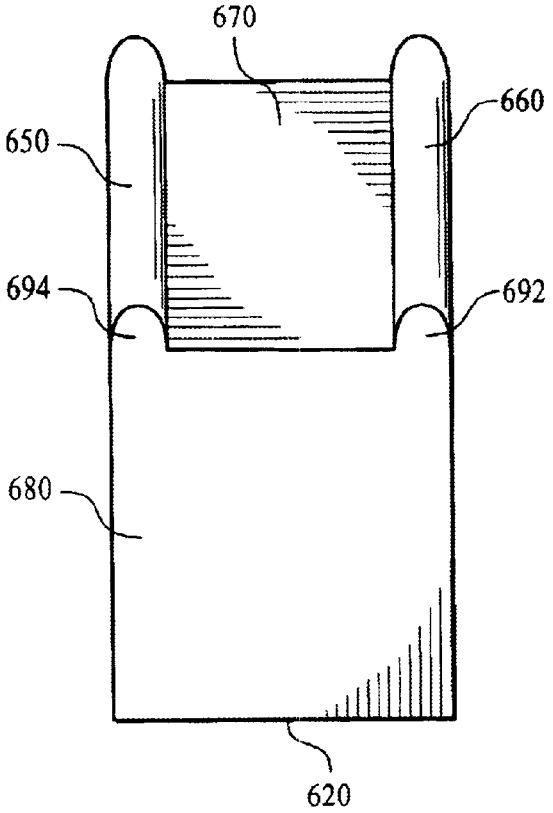
FIG. 4 is a perspective view of the ninth embodiment heel elevator support.

FIG. 4 is a perspective view of the ninth embodiment of the heel elevator support. The ninth embodiment is a heel elevator support in which the ramparts are bolsters and the supplemental support is integral with the heel elevator support. Visible in FIG. 4 is the rear end 620, the sloping upper surface 670, the upper surface 670 of the heel elevator portion, the left bolster 650, the right bolster 660, the end 694 of the left bolster, and the end 692 of the right bolster.

Figure 5:
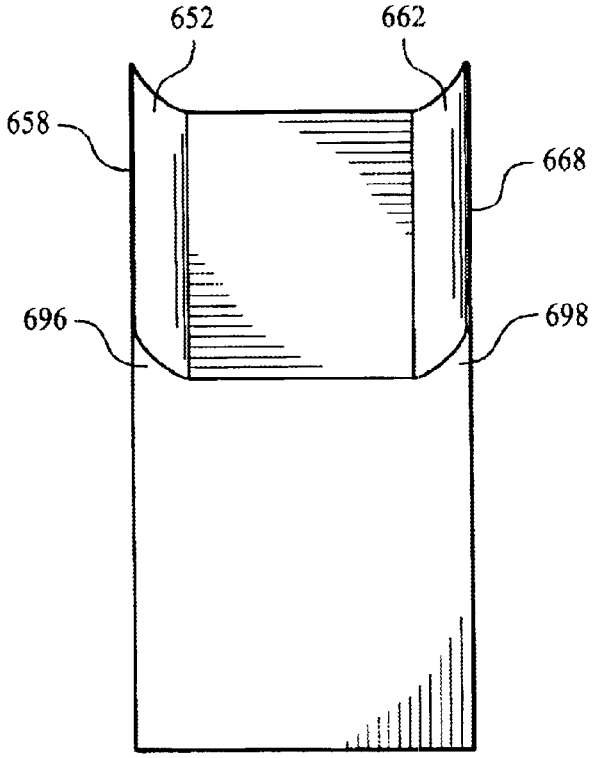
FIG. 5 is a perspective view of the tenth embodiment heel elevator support.

FIG. 5 is a perspective view of the tenth embodiment of the heel elevator support. The tenth embodiment is a heel elevator support in which the ramparts are palisades and the supplement support is integral with the heel elevator support. The tenth embodiment is identical to the ninth embodiment, and FIG. 5 is identical with FIG. 4 except that a left palisade 658 and a right palisade 668 is present instead of a left bolster and a right bolster (650 and 660 in FIG. 4, respectively). Visible in FIG. 5 is the concave surface 652 and end 696 of the left palisade 650 and the concave surface 662 and end 698 of the right palisade 660.

Figure 6:
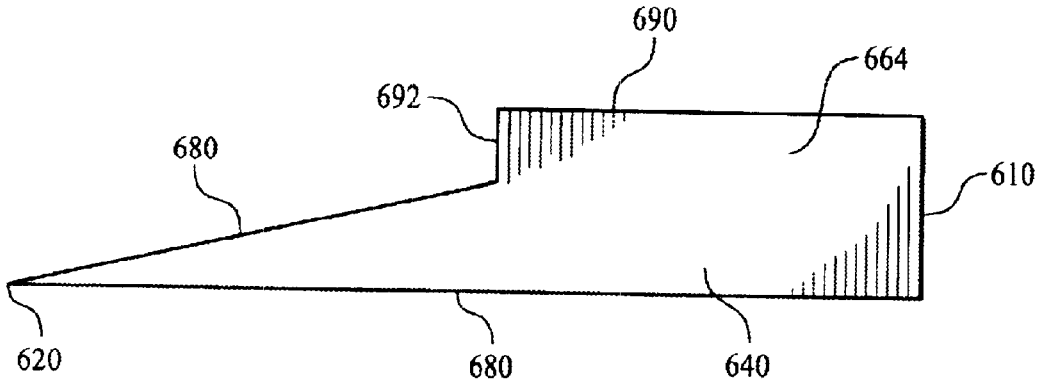
FIG. 6 is a side view of the ninth and tenth embodiment heel elevator support.

FIG. 6 is a side view of the ninth and tenth embodiments of the heel elevator support. In the ninth and tenth embodiments, the supplemental support is integral with the heel elevator support. Visible in FIG. 6 is the bottom 680 of the support, the front end 610, the rear end 620, the sloping upper surface 670, the right side 640, the right rampart 690, the outer surface 664 of the right rampart, and the end 692 of the right rampart.

Figure 7:
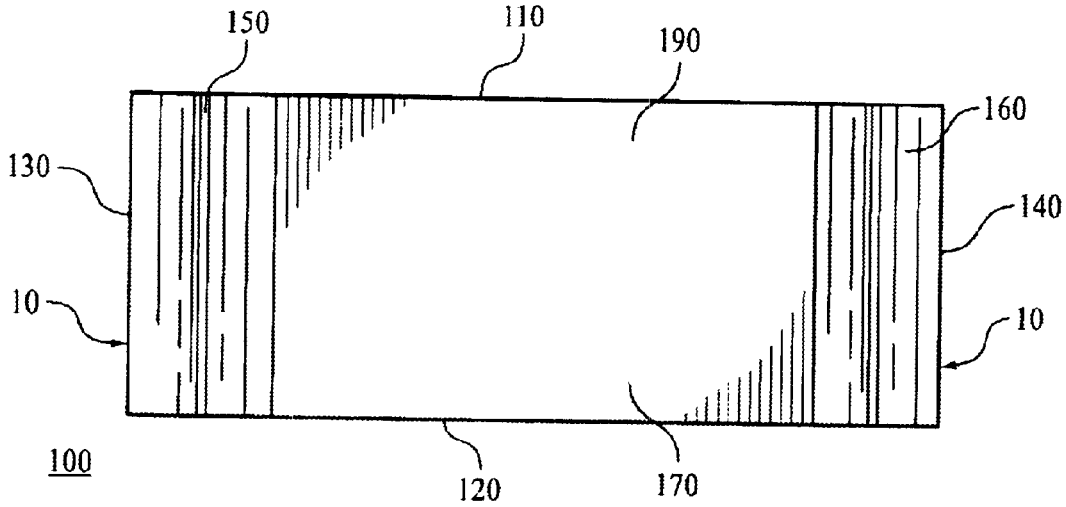
FIG. 7 shows a plan view of the first embodiment heel elevator support.

FIG. 7 is a plan view of the first embodiment heel elevator support 100. Depicted in FIG. 7 is the front end 110, the rear end 120, the left side 130 and the right side 140, and the top surface 170. The width of the support from the left side to the right side approximates the width of a bed, and is approximately 26 to 36 inches. The length from the front end to the back end approximates the length of a patient's lag from knee to Achilles tendon. In a preferred embodiment the length ranges from 12 to 25 inches. Ramparts elevated above the surface of the support run along the left and right sides to prevent the patient's legs from falling from the support. In the first embodiment the ramparts are bolsters with the upper surface rounded. A left bolster 150 is integral with the support at the left side 130 and is oriented parallel to the left side. A right bolster 160 is integral with the support at the right side 140 and is oriented parallel to the right side. The bolsters extend above the top surface of the support approximately 1 to 8 inches. A cover 190 encloses the entire cushion 125.

Figure 8:
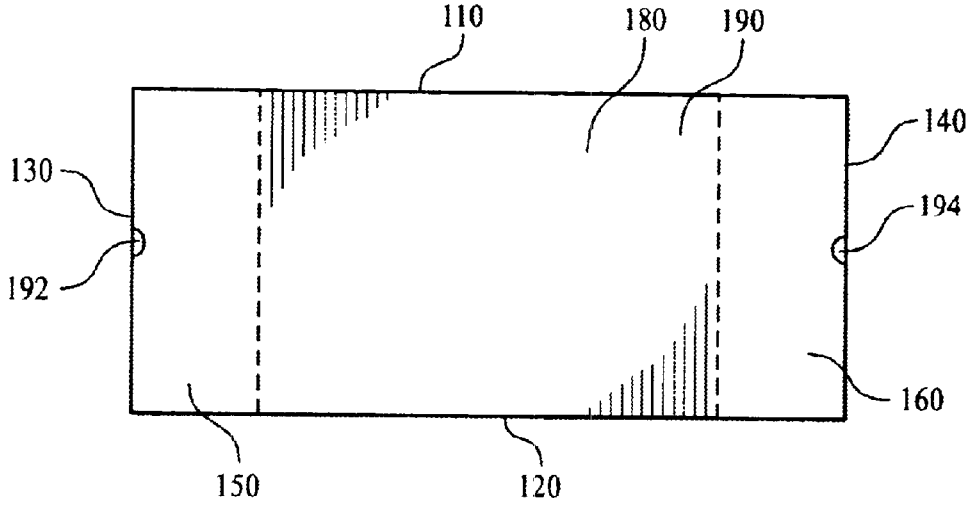
FIG. 8 shows a bottom view of the first embodiment heel elevator support.

FIG. 8 is a bottom view of the first embodiment heel elevator support. Depicted in FIG. 8 is the front end 110, rear end 120, the left side 130, the right side 140, and the bottom surface 180. Dotted lines indicate the position of the left bolster 150 and right bolster 160 which are not visible in FIG. 8. A cover 190 encloses the entire cushion 125. A left hole 192 in the support cover 190 and right hole 194 in the support cover 190 are visible in FIG. 8.

Figure 9:
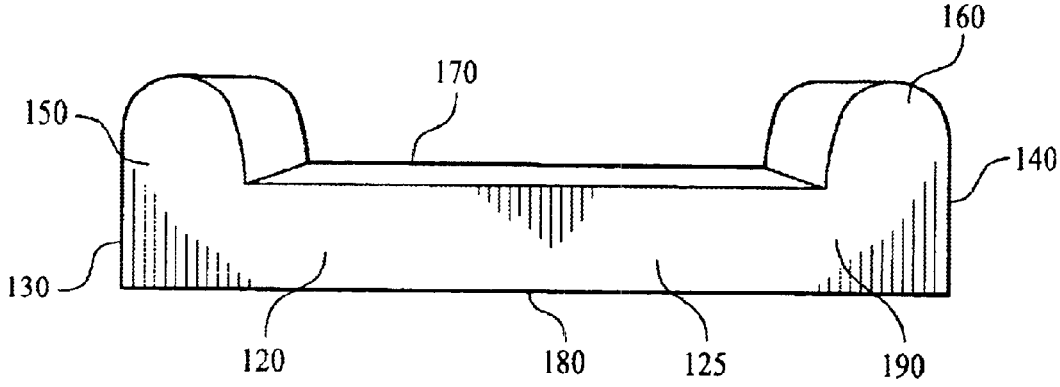
FIG. 9 shows a end view of the first embodiment heel elevator support.

FIG. 9 is an end view of the first embodiment heel elevator support from the rear end 120. Depicted in FIG. 9 is the upper surface 170, the left bolster 150, left side 130, right bolster 160, right side 140 and bottom surface 180. A cover 190 encloses the entire cushion 125.

Figure 10:
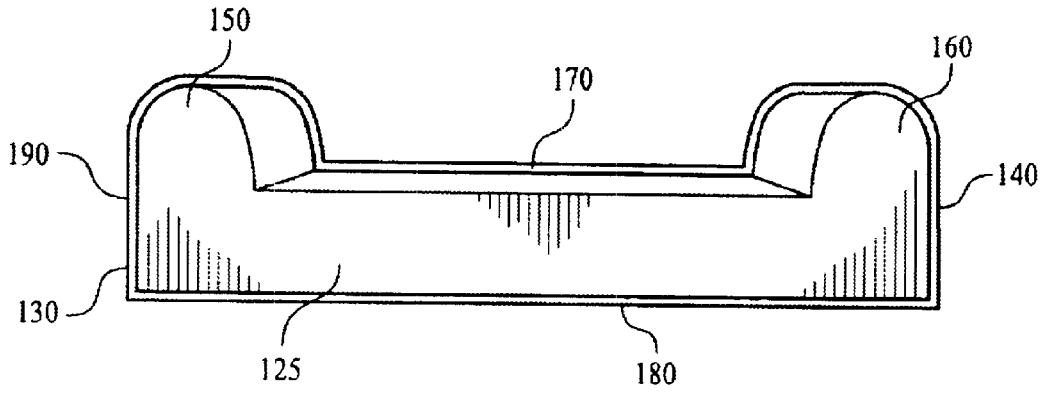
FIG. 10 shows a cross section of the first embodiment heel elevator support taken at 10—10 of FIG. 9.

FIG. 10 is a cross section of FIG. 7 taken at 10—10. The features shown in FIG. 10 are the same as the features shown in FIG. 7. Also shown in FIG. 10 is the cushion 125 and the cover 190.

Figure 11:
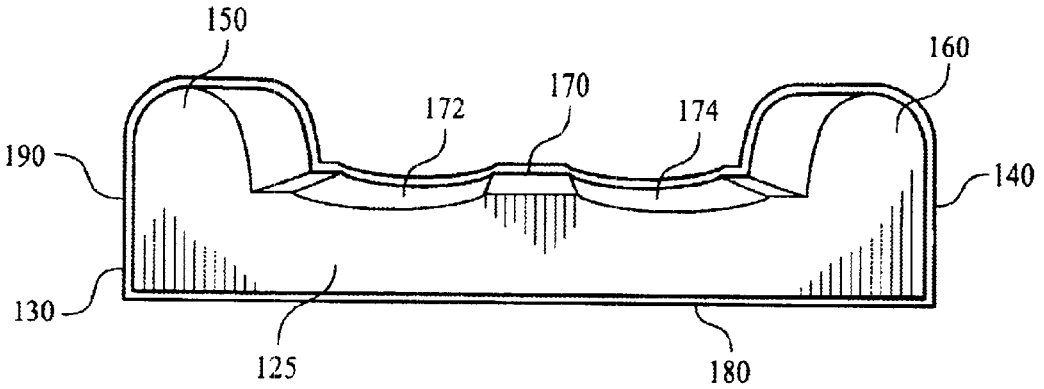
FIG. 11 shows a cross section of the second embodiment heel elevator support.

FIG. 11 is a cross section of a second embodiment heel support cushion. This embodiment is identical to the first embodiment heel elevator support except for the inclusion on the top surface 170 of the cushion 125 of two indentations which are parallel with the bolsters, a left indentation 172 and a right indentation 174. The indentations 172 and 174 have a depth of 1 to 3 inches and run from the front end to the rear end of the cushion and run parallel to the bolsters. The other features shown in FIG. 11 are the same as the corresponding features in FIG. 10.

Figure 12:
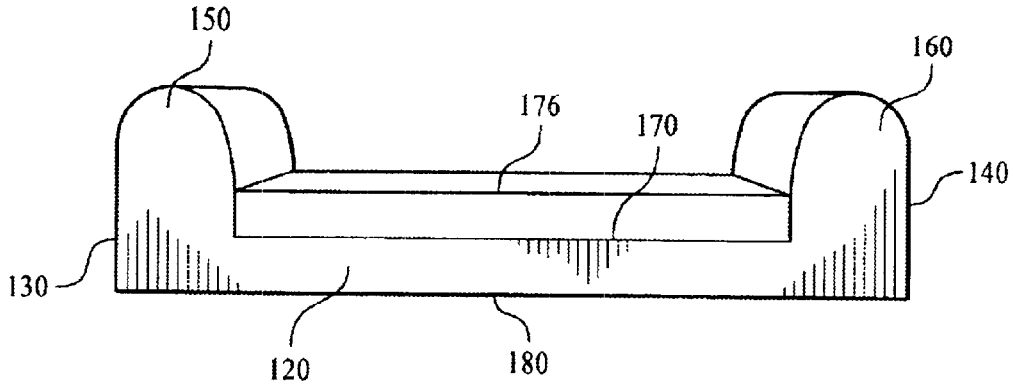
FIG. 12 shows a end view of the third embodiment heel elevator support.

FIG. 12 is an end view of a third embodiment heel elevator support. The third embodiment support is the same as the first embodiment except that the distance between the upper surface 170 and the bottom is approximately 1 to 3 inches less in the third embodiment than in the first embodiment. An insert of visco-elastic foam 176 covers the upper surface 170 of the third embodiment support. The insert has a thickness of 1 to 3 inches. The insert 176 is rectangular and covers the upper surface between the front end, the rear end 120, the left bolster 150 and the right bolster 160. The bolsters 150 and 160 extend 1 to 8 inches above the insert 176. The insert 176 has a composition different from that of the cushion of the first embodiment heel support (125 in FIG. 10). The other features shown in FIG. 12 are the same as the corresponding features in FIG. 11.

Figure 13:
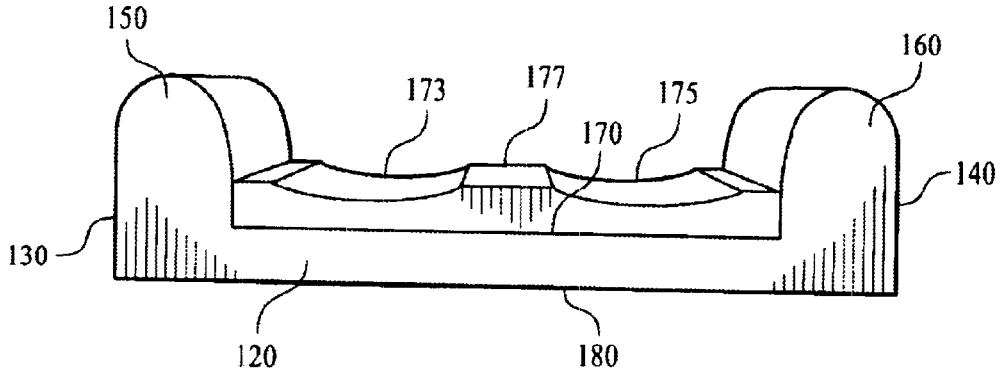
FIG. 13 shows a end view of the fourth embodiment heel elevator support.

FIG. 13 is an end view of a fourth embodiment heel elevator support. The fourth embodiment is identical to the third embodiment heel elevator support except for the inclusion on the top surface 177 of the insert of two indentations which are parallel to the bolsters, a left indentation 173 and a right indentation 175. The indentations have a depth of 1 to 3 inches and run parallel to the bolsters from the front end to the rear end. The other features shown in FIG. 13 are the same as the corresponding features in FIG. 12.

Figure 14:
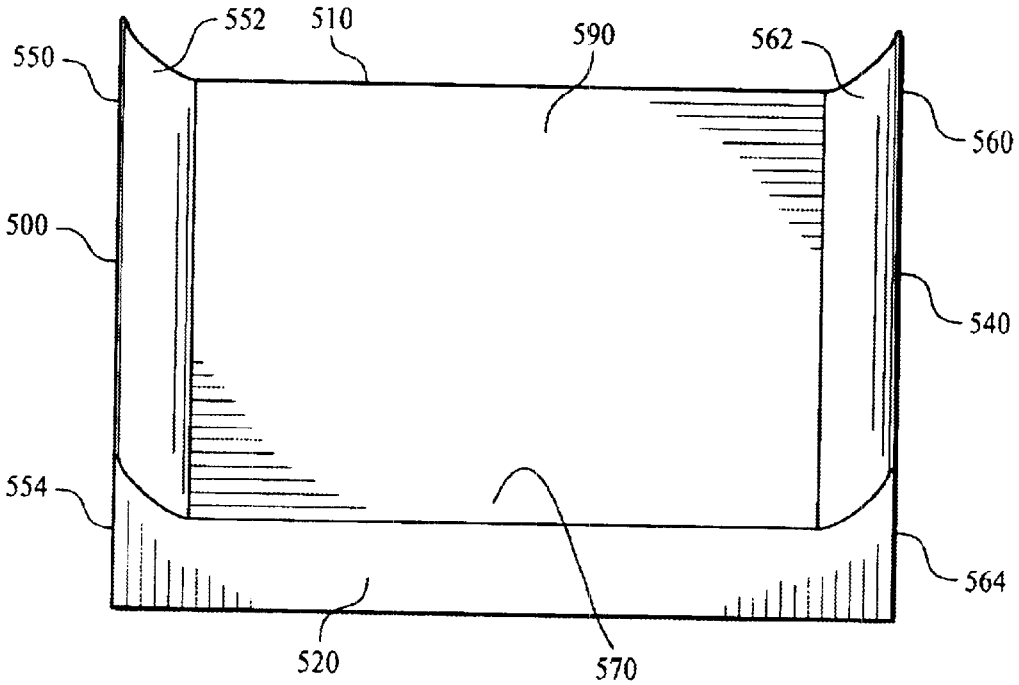
FIG. 14 shows a perspective view of the fifth embodiment heel elevator support.

FIG. 14 is a perspective view of the fifth embodiment heel elevator support 500. Depicted in FIG. 14 is the front end 510, the rear end 520, the left side 530 and the right side 540, and the top surface 570. The width of the fifth embodiment support from the left side to the right side is less than the width of the first embodiment and is approximately 22 to 32 inches. The length from the front end to the back end approximates the length of a patient's lag from knee to Achilles tendon. In a preferred embodiment the length ranges from 12 to 25 inches. In the fifth embodiment the ramparts are palisades 550 and 560 with a concave surface 552 and 562, respectively, facing the center of the support. A left palisade 550 is integral with the support at the left side 530 and is oriented parallel to the left side. A right palisade 560 is integral with the support at the right side 540 and is oriented parallel to the right side. The left palisade 550 has a concave side 552 which rises from the top surface 570 of the support and a vertical side 554 which is an extension of the left side 530 of the support. The right palisade 560 has a concave side 562 which rises from the top surface 570 of the support and a vertical side 564 which is an extension of the right side 540 of the support. The palisades extend above the top surface 570 of the support approximately 1 to 4 inches. A cover 590 encloses the entire cushion.

The bottom view of the fifth embodiment is the same as the bottom view of the first embodiment in FIG. 8. The fifth embodiment support differs from the first embodiment primarily in the substitution of palisades for bolsters. In addition, the fifth embodiment is narrower than the first embodiment. The fifth embodiment may be more easily packaged than the first embodiment and the fifth embodiment requires less material in manufacture.

Figure 15:
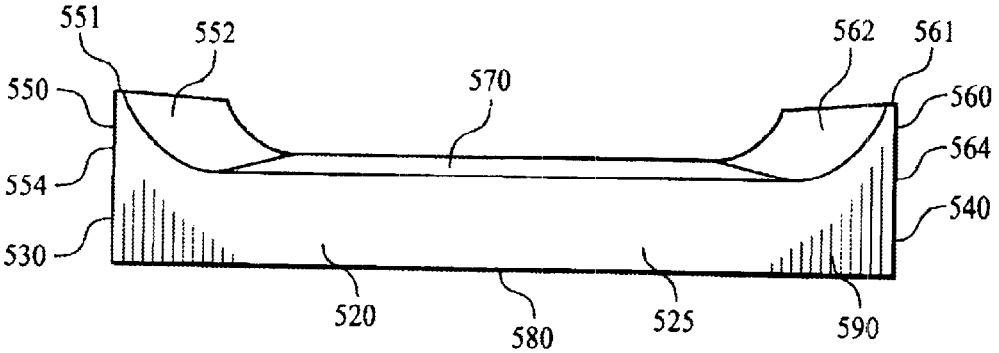
FIG. 15 shows an end view of the fifth embodiment heel elevator support.

FIG. 15 is an end view of the heel elevator support from the rear end 520. Depicted in FIG. 15 is the upper surface 570, the left palisade 550 comprised of the concave side 552 and vertical side 554, left side 530, right palisade 560 comprised of the concave side 562 and vertical side 564, right side 540 and bottom surface 580. The tops 551 and 561 of the palisades are preferably flat. A cover 590 encloses the entire cushion 525.

Figure 16:
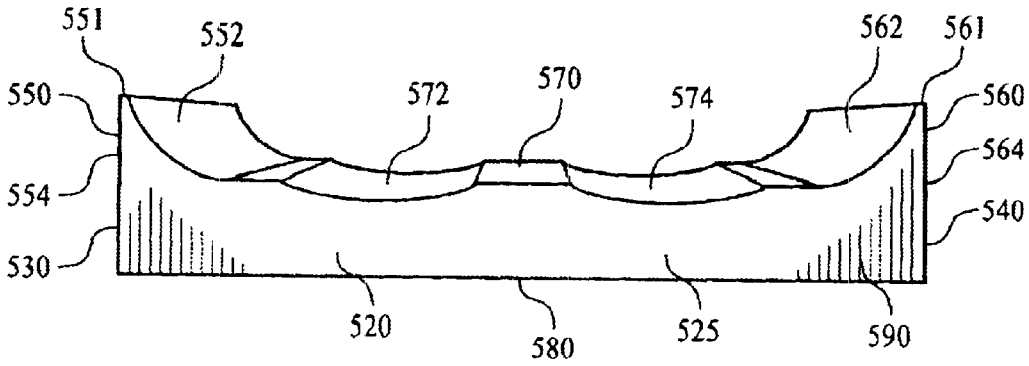
FIG. 16 shows an end view of the sixth embodiment heel elevator support.

FIG. 16 is an end view of a sixth embodiment heel support cushion. This embodiment is identical to the fifth embodiment heel elevator support except for the inclusion on the top surface 570 of the cushion 525 of two indentations which are parallel with the palisades, a left indentation 572 and a right indentation 574. The indentations 572 and 574 have a depth of 1 to 3 inches and run from the front end to the rear end of the cushion and run parallel to the palisades. The other features shown in FIG. 16 are the same as the corresponding features in FIG. 15.

Figure 17:
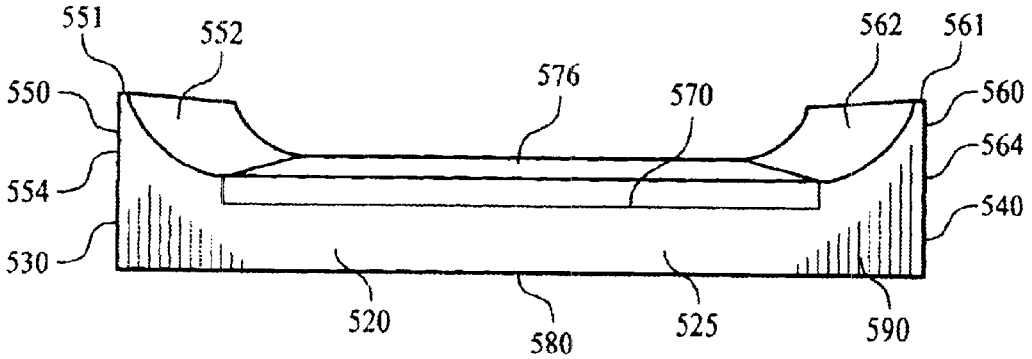
FIG. 17 shows an end view of the seventh embodiment heel elevator support.

FIG. 17 is an end view of a seventh embodiment heel elevator support. The seventh embodiment support is the same as the fifth embodiment except that the distance between the upper surface 570 and the bottom 580 of the cushion is approximately 1 to 3 inches less in the seventh embodiment than in the fifth embodiment. An insert of visco-elastic foam 576 covers the upper surface 570 of the fifth embodiment support. The insert has a thickness of 1 to 3 inches. The insert 576 is rectangular and covers the upper surface between the front end, the rear end 520, the left palisade 550 and the right palisade 160. The palisades 550 and 560 extend above the insert 576 approximately 1 to 4 inches. The insert 576 has a composition different from that of the cushion of the fifth embodiment heel support 525 in FIG. 16. The other features shown in FIG. 17 are the same as the corresponding features in FIG. 16.

Figure 18:
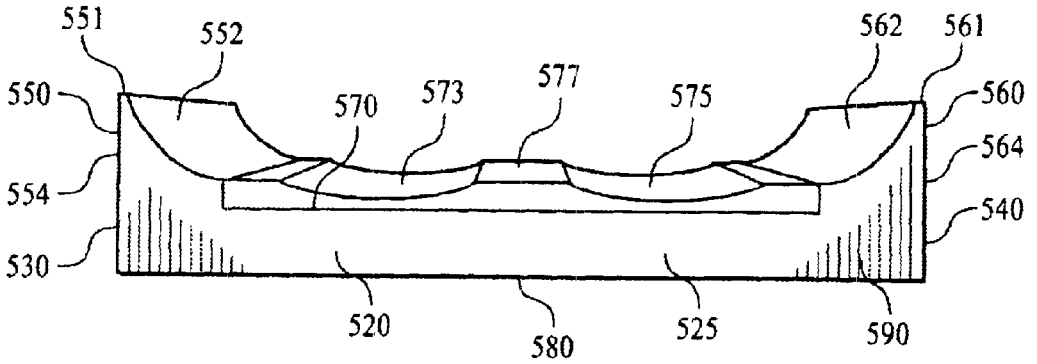
FIG. 18 shows an end view of the eighth embodiment heel elevator support.

FIG. 18 is an end view of a eighth embodiment heel elevator support. The eighth embodiment is identical to the seventh embodiment heel elevator support except for the inclusion on the top surface 577 of the insert of two indentations which are parallel to the palisades, a left indentation 573 and a right indentation 575. The indentations have a depth of 1 to 3 inches and run parallel to the palisades from the front end to the rear end. The other features shown in FIG. 18 are the same as the corresponding features in FIG. 17.

Figure 19:
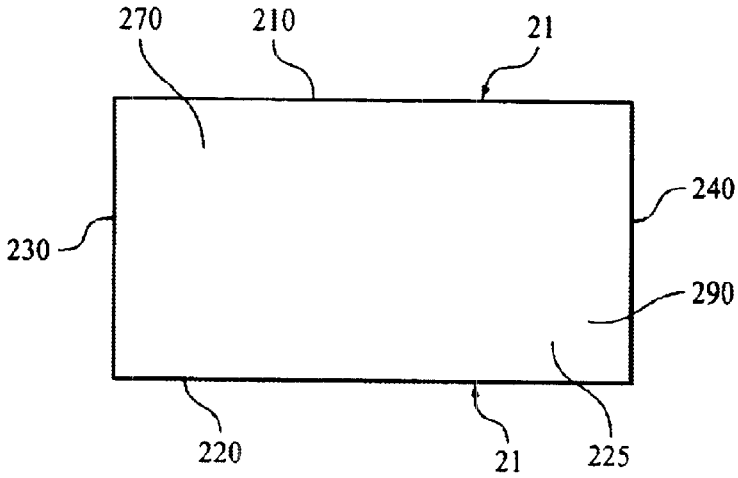
FIG. 19 shows a plan view of the supplemental heel elevator support.

FIG. 19 is a plan view of the supplemental support 200. Depicted in FIG. 19 is the front end 210, the rear end 220, the left side 230 and the right side 240 and the top surface 270. The width of the support from the left side to the right side approximates the width of a bed, and is approximately 26 to 36 inches. The length from the front end to the back end is approximately 12–24 inches. A cover 290 covers the entire cushion 225.

Figure 20:
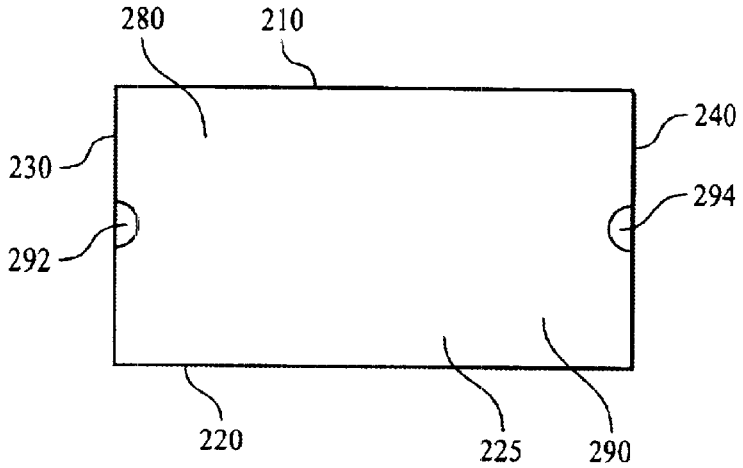
FIG. 20 shows bottom view of the supplemental heel elevator support.

FIG. 20 is a bottom view of the supplemental support. Depicted in FIG. 20 is the front end 210, the rear end 220, the left side 230, the right side 240, and the bottom surface 280. A cover 290 encloses the entire cushion 225. A left hole 292 in the support cover 290 and right hole 294 in the support cover 290 are visible in FIG. 20.

Figure 21:
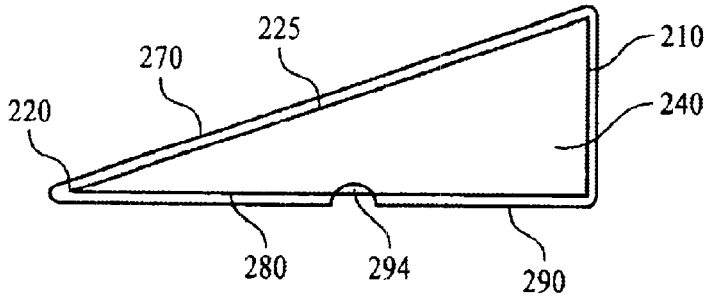
FIG. 21 shows cross section of the supplemental heel elevator support taken at 21—21 of FIG. 19.

FIG. 21 is a cross section of the supplemental support taken at line 21—21. Features visible in FIG. 21 are identical to the corresponding features shown in FIGS. 19 and 20. Also shown in FIG. 21 is the cushion 225 and the cover 290. Also visible are the right hole 294 in the support cover 290.

Figure 22:
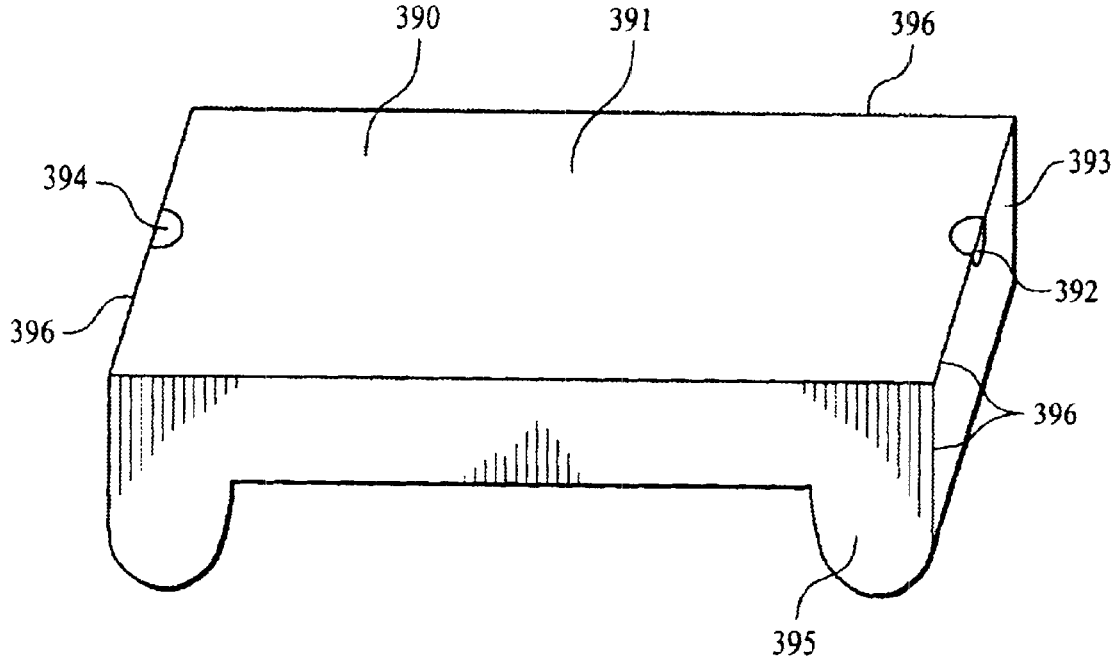
FIG. 22 shows a bottom side of the first embodiment heel elevator support showing the first embodiment cover.

FIG. 22 is a bottom view of the first embodiment heel elevator support showing the first embodiment cover 390. The first embodiment cover is intended for single use. The first embodiment heel elevator support using the first embodiment cover is disposable and is intended for single use. The first embodiment cover is comprised of water-resistant elastomer material. A preferred material is thermoplastic polyurethane film manufactured by J. P. Stevens Elastomerics of Holyoke, Mass.

In FIG. 22 the first embodiment cover 390 is shown with the bottom cover panel 391, left cover panel 393, and rear end panel 395. Also visible is the left cover hole 392 which ventilates the bottom cover panel 391 and left side panel 393 and the right cover hole 394 which ventilates the bottom cover panel 391 and the right side panel (not visible in FIG. 22). The holes in the coating allow the escape of air from the support when it is packaged, and allows return of air when the shape of the support is reconstituted when the package is opened. The holes may be covered with mesh fabric.

The first embodiment cover panels are attached to each other by radio frequency (RF) welding shown along the seams 396. The heel elevator support is constructed by first shaping the cushion, then applying cover panels, then welding the panels together by radio frequency welding. Other suitable methods for attaching the panels together, such as sewing, heat sealing, or gluing with permanent adhesives, such as epoxy adhesives, may be used.

Figure 23:
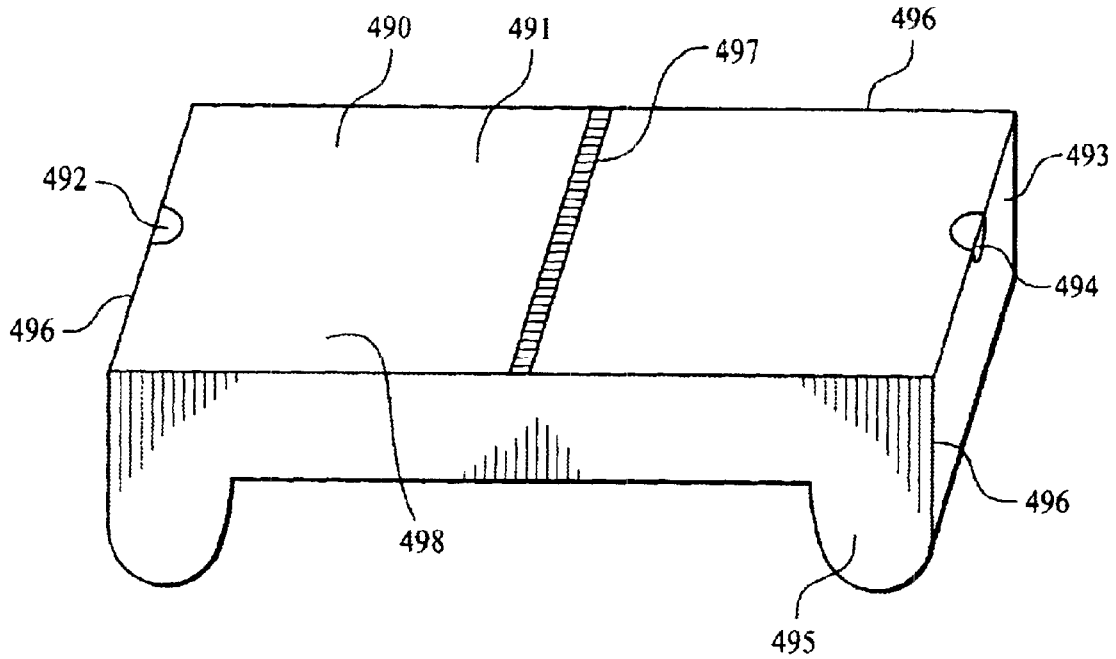
FIG. 23 shows a bottom side of the first embodiment heel elevator support showing the second embodiment cover.

FIG. 23 is a bottom view of the first embodiment heel elevator support showing the second embodiment cover 490. The second embodiment cover is intended for multiple use. The first embodiment heel elevator support using the second embodiment cover is intended for multiple use. The second embodiment cover is comprised of water-resistant coated fabric material. A preferred material is 70 denier nylon taffeta manufactured by Stafford Textiles of Toronto, Ontario, Canada. Other suitable fabric materials may be used, such vinyl and rayon may be used.

The fabric material is coated with a suitable water-resistant polymer such as polyurethane, butyl rubber, vinyl, and thermoplastic urethane. A preferred coatings include polycast coat laminate and Staph Chek medical grade vinyl. Staph Check is a trademark owned by Herculite Products of Emigsville, Pa.

In FIG. 23 the second embodiment cover 490 is shown with the bottom cover panel 491, left cover panel 493, and rear end panel 495. Also visible is the left cover hole 492 which ventilates the bottom cover panel 491 and left side panel and the right cover hole 494 which ventilates the bottom cover panel 491 and the right side panel (not visible in FIG. 23). The holes in the coating allow the escape of air from the support when it is packaged, and allows return of air when the shape of the support is reconstituted when the package is opened. The holes may be covered with a mesh fabric.

The second embodiment cover panels are attached to each other by sewing along the seams 496. A zipper 497 which runs along three sides of the bottom cover panel 491 opens the cover so the cushion can be inserted and removed. The heel elevator support is constructed by first shaping the cushion, assembling the second embodiment cover by sewing together the cover panels, inserting the cushion into the cover through the opening 498 defined by the zipper 497, and closing the opening using the zipper. Other suitable methods for attaching the panels together, such as radio frequency welding, heat sealing, or gluing with permanent adhesives, such as epoxy adhesives, may be used. Other suitable means for closing the hole 498 such as hook and fabric closures, buttons, and snaps may be used.

The reusable water-resistant elastomer material is 70 denier nylon taffeta manufactured by Stafford Textiles of Toronto, Ontario, Canada. The nylon elastomer is coated with a polycast coat laminate or with Staph Chek medical grade vinyl. Staph Check is a trademark owned by Herculite Products of Emigsville, Pa.

Figure 24:
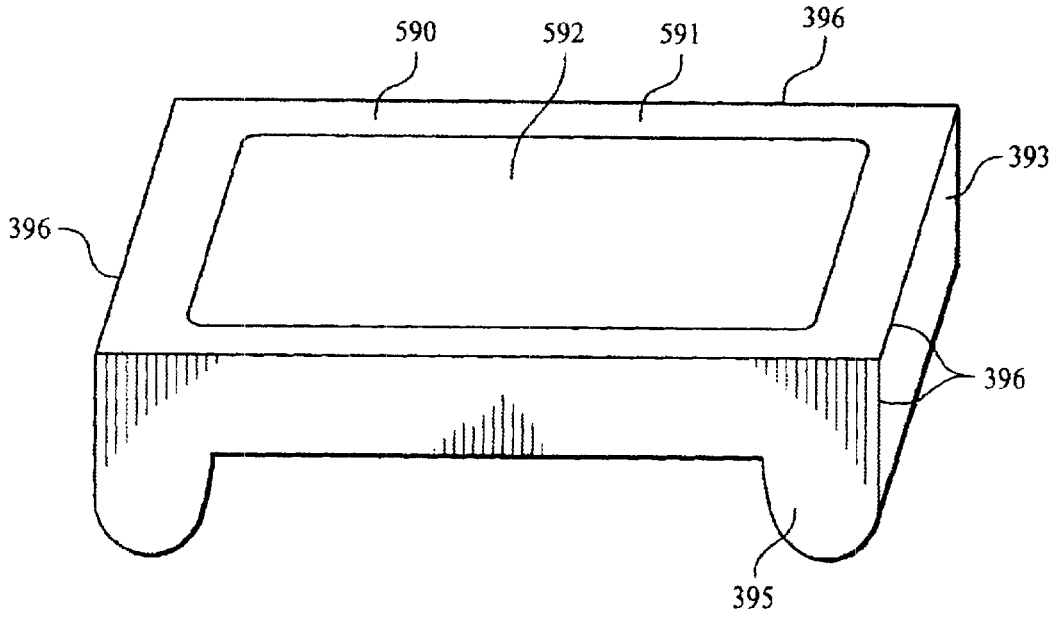
FIG. 24 shows a bottom side of the first embodiment heel elevator support showing the third embodiment cover.

FIG. 24 is a bottom view of the first embodiment heel elevator support showing the third embodiment cover 590. The third embodiment cover is identical to the first embodiment cover (shown in FIG. 22) except the central portion 592 of the bottom panel 391 has been removed leaving the bottom panel or flange 591 which extends from and is attached to the front, rear, and side panels. A large portion of the bottom of the cushion is not covered when the third embodiment cover is used. The third embodiment cover 590 is assembled as is the first embodiment cover except the third embodiment cover is assembled without including a cushion. After the third embodiment cover is assembled, the cushion is inserted into the bottom of the cover and the cover pulled over the cushion. The flange 591 serves to retain the cover on the cushion. The elasticity of the flange retains the cover in place. Alternatively, an elastic cord may be added to the open edge of the flange for additional retention.

Although the first embodiment heel elevator support has been described with three embodiments of covers, similar covers with similar structures and compositions may be used with the supplemental support and with all embodiments of the heel elevator support.

The cushion material used in all embodiments of the heel elevator support and supplemental support is any suitable foam material, such as polyurethane foam, copolymer foam, latex foam. A preferred foam is polyurethane foam. The preferred foam is available in several variations, such a 1A high resiliency; HD high density, VE viscoelastic, which has very high density. Latex foam is less preferred because of the hazard of incurring allergic reactions to the foam. In a preferred foam an antimicrobial additive is included in the foam, Bio-Pruf. Bio-Pruf is a trademark for a antimicobial additive obtainable from Morton International of Cincinnati, Ohio. The foam density range is from 1.2 to 4.6 pounds per cubic foot. The firmness of foam is measured by indention force deflection (IFD). A preferred foam has an IFD of 15 to 50.

It is important that the heel elevator support and supplemental support be capable of reduction in volume during shipping, storage, and generally when not in use. The relatively large supports place severe burdens on the storage facilities of hospitals and nursing facilities when the supports are stored. This burden is especially high with cushions using the first embodiment cover, which are disposable and have high inventory requirements.

The supply volume problem is alleviated by reducing the volume of packaged supports. In this process, the support is first compressed and reduced in volume to not more than 15% of freely expanded volume and the compressed support is then packaged by tightly wrapping with a suitably strong material, such as plastic film or fabric straps. In an alternative process the compressed support is placed into a cylindrical cover which is manufactured of a suitable strong material such as plastic film or fabric. Removal of the packing material or the cylindrical cover allows the supports to resume a freely expanded volume and be ready for use.

In a second method of packing supports, the cushion without a cover is compressed and reduced in volume to not more than 15% of freely expanded volume and the compressed support is then packaged by tightly wrapping with a suitably strong material, such as plastic film or fabric straps. In an alternative process the compressed support is placed into a cylindrical cover which is manufactured of a suitable strong material such as plastic film or fabric. To prepare the support for use, the packing material or cover is removed, the cushion is allowed to resume the freely expanded volume, and a third embodiment cover is placed over the cushion, thus providing a complete support.

It will be apparent to those skilled in the art that the examples and embodiments described herein are by way of illustration and not of limitation, and that other examples may be used without departing from the spirit and scope of the present invention, as set forth in the appended claims.

We claim:

1. A heel elevator support for stimulating circulation in the lower extremities and for preventing and managing heel pressure ulcers comprising: a rectangular cushion having a front end and a back end, a left and a right side, and a top and bottom surface, the cushion having a width from the left side to the right side approximating or less than the width of a bed, the cushion having a length from the front end to the back end approximating the length of a patient's leg from knee to Achilles tendon, the cushion having from the top surface to the bottom surface a height adequate to stimulate circulation in the lower extremities, two ramparts integral with the cushion, a first rampart located at the left side and parallel to the left side, a second rampart located at the right side and parallel to the right side, each rampart extending above the upper surface of the cushion, the top surface free of extensions above the top surface other than the ramparts, the support comprised of a foam material, and the support having a cover comprised of a water-resistant elastomer material.

2. The heel elevator support of claim 1 wherein the width of the cushion is approximately 26 to 36 inches.

3. The heel elevator support of claim 1 wherein the length of the cushion is approximately 12 to 25 inches.

4. The heel elevator support of claim 1 wherein the height of the cushion is approximately 3 to 6 inches.

5. The heel elevator support of claim 1 wherein the rampart extends above the upper surface of the cushion approximately 1 to 8 inches.

6. The heel elevator support of claim 1 wherein the ramparts are bolsters.

7. The heel elevator support of claim 1 wherein the ramparts are palisades.

8. The heel elevator support of claim 1 wherein the foam is polyurethane foam or copolymer foam.

9. The heel elevator support of claim 1 wherein the foam is polyurethane foam.

10. The heel elevator support of claim 1 wherein the foam is high resiliency, high density, or viscoelastic foam.

11. The heel elevator support of claim 1 wherein the density of the foam is from 1.2 to 2.4 pound per cubic foot.

12. The heel elevator support of claim 1 wherein the foam further comprises an antimicrobial additive.

13. The heel elevator support of claim 12 wherein the antimicrobial additive is vinyzine or biopruf.

14. The heel elevator support of claim 1 wherein the upper surface of the cushion further comprises leg indentations, the leg indentations parallel to the ramparts.

15. The heel elevator support of claim 1 wherein the cover comprises a clear elastomer film or a coated nylon fabric.

16. The coated nylon fabric of claim 15 wherein the coating is urethane or butyl rubber.

17. The heel elevator support of claim 1 wherein the cover is a clear elastomer film.

18. The heel elevator support of claim 1 wherein the cover is a coated nylon fabric.

19. The heel elevator support of claim 1 wherein the cover is manufactured from strips of elastomer film welded together by radio frequency welding.

20. The heel elevator support of claim 1 further comprising a supplemental support integral with the heel elevator support.

21. A packaged heel elevator support comprising in combination, a heel elevator support comprised of a foam cushion with ramparts, the cushion covered by a water-resistant elastomer material, the water-resistant elastomer material having holes for the passage of air, the support compressed to not more than 15% of its freely expanded volume, the compressed support rolled, and a elongated flexible tubular casing or straps, the rolled compressed support inserted into and enclosed by the elongated flexible tubular casing or the straps.

22. The packaged heel elevator support of claim 21 further comprising a supplemental support.

23. The packaged heel elevator support of claim 21 wherein the supplemental support is integral with the heel elevator support.

24. A packaged heel elevator support comprising in combination, a heel elevator support comprised of a foam cushion with ramparts, the cushion covered by a water-resistant elastomer material, the water-resistant elastomer material having holes for the passage of air, the support compressed to not more than 15% of its freely expanded volume, and a flexible, air-impermeable, wrap, the compressed support enclosed by the flexible, air-impermeable wrap.

25. A packaged heel elevator support comprising in combination, a heel elevator support comprised of a foam cushion with ramparts, the support compressed to not more than 15% of its freely expanded volume, the compressed support rolled, a elongated flexible tubular casing or straps, the rolled compressed support inserted into and enclosed by the elongated flexible tubular casing or the straps, and a cover comprised of a water-resistant elastomer material, the cover capable of enclosing a freely expanded heel elevator support inserted into the cover, the cover retained on the fully expanded heel elevator support by a flange.

26. A heel elevator support for stimulating circulation in the lower extremities and for preventing and managing heel pressure ulcers comprising: a rectangular cushion having a front end and a back end, a left and a right side, and a top and bottom surface, the cushion having a width from the left side to the right side approximating or less than the width of a bed, the cushion having a length from the front end to the back end approximating the length of a patient's leg from knee to Achilles tendon, the cushion having from the top surface to the bottom surface a height adequate to stimulate circulation in the lower extremities, two ramparts integral with the cushion, a first rampart located at the left side and parallel to the left side, a second rampart located at the right side and parallel to the right side, each rampart extending above the upper surface of the cushion, the support comprised of a foam material, and the support having a cover comprised of a water-resistant elastomer material, wherein the cushion further comprises a cushion inlay of foam of composition differing from the composition of the cushion foam, the inlay located on the upper surface of the cushion.

27. A heel elevator support for stimulating circulation in the lower extremities and for preventing and managing heel pressure ulcers comprising: a rectangular cushion having a front end and a back end, a left and a right side, and a top and bottom surface, the cushion having a width from the left side to the right side approximating or less than the width of a bed, the cushion having a length from the front end to the back end approximating the length of a patient's leg from knee to Achilles tendon, the cushion having from the top surface to the bottom surface a height adequate to stimulate circulation in the lower extremities, two ramparts integral with the cushion, a first rampart located at the left side and parallel to the left side, a second rampart located at the right side and parallel to the right side, each rampart extending above the upper surface of the cushion, the support comprised of a foam material, and the support having a cover comprised of a water-resistant elastomer material, the cushion further comprising a cushion inlay of foam of composition differing from the composition of the cushion foam, the inlay located on the upper surface of the cushion, wherein the upper surface of the cushion inlay has leg indentations, the indentations parallel to the ramparts.

28. A heel elevator support for stimulating circulation in the lower extremities and for preventing and managing heel pressure ulcers comprising: a rectangular cushion having a front end and a back end, a left and a right side, and a top and bottom surface, the cushion having a width from the left side to the right side approximating or less than the width of a bed, the cushion having a length from the front end to the back end approximating the length of a patient's leg from knee to Achilles tendon, the cushion having from the top surface to the bottom surface a height adequate to stimulate circulation in the lower extremities, two ramparts integral with the cushion, a first rampart located at the left side and parallel to the left side, a second rampart located at the right side and parallel to the right side, each rampart extending above the upper surface of the cushion, the support comprised of a foam material, and the support having a cover comprised of a water-resistant elastomer material, further comprising holes in the cover for the escape of air from the support.

29. A heel elevator support for stimulating circulation in the lower extremities and for preventing and managing heel pressure ulcers comprising: a rectangular cushion having a front end and a back end, a left and a right side, and a top and bottom surface, the cushion having a width from the left side to the right side approximating or less than the width of a bed, the cushion having a length from the front end to the back end approximating the length of a patient's leg from knee to Achilles tendon, the cushion having from the top surface to the bottom surface a height adequate to stimulate circulation in the lower extremities, two ramparts integral with the cushion, a first rampart located at the left side and parallel to the left side, a second rampart located at the right side and parallel to the right side, each rampart extending above the upper surface of the cushion, the support comprised of a foam material, and the support having a cover comprised of a water-resistant elastomer material, wherein the cover is manufactured from strips of coated fabric sewn together and secured about the support by zippers or hook and loop closures.

30. A heel elevator support for stimulating circulation in the lower extremities and for preventing and managing heel pressure ulcers comprising: a rectangular cushion having a front end and a back end, a left and a right side, and a top and bottom surface, the cushion having a width from the left side to the right side approximating or less than the width of a bed, the cushion having a length from the front end to the back end approximating the length of a patient's leg from knee to Achilles tendon, the cushion having from the top surface to the bottom surface a height adequate to stimulate circulation in the lower extremities, two ramparts integral with the cushion, a first rampart located at the left side and parallel to the left side, a second rampart located at the right side and parallel to the right side, each rampart extending above the upper surface of the cushion, the support comprised of a foam material, and the support having a cover comprised of a water-resistant elastomer material, wherein the cover is retained on the cushion by a flange which extends from the sides of the cover onto the bottom of the cushion.

31. A heel elevator support for stimulating circulation in the lower extremities and for preventing and managing heel pressure ulcers comprising: a rectangular cushion having a front end and a back end, a left and a right side, and a top and bottom surface, the cushion having a width from the left side to the right side approximating or less than the width of a bed, the cushion having a length from the front end to the back end approximating the length of a patient's leg from knee to Achilles tendon, the cushion having from the top surface to the bottom surface a height adequate to stimulate circulation in the lower extremities, two ramparts integral with the cushion, a first rampart located at the left side and parallel to the left side, a second rampart located at the right side and parallel to the right side, each rampart extending above the upper surface of the cushion, the support comprised of a foam material, and the support having a cover comprised of a water-resistant elastomer material, a wedge shaped supplemental support for use in conjunction with the heel elevator support, the supplemental support comprising a secondary cushion with a cover, the supplemental support having a front end and a rear end, a left side and a right side, an upper surface and a lower surface, the supplemental support having the front end in contact with the rear end of the heel elevator support, the height of upper surface at the front end of the supplemental support approximating the height of the heel elevator support, the height of the upper surface at the rear end of the supplemental support declining to the level of the lower surface of the supplemental support, the upper surface of the supplemental support sloping from the front end to the rear end, the width of the supplemental support approximating the width of the heel elevator support, the supplemental cushion comprised of a foam material, and the supplemental cushion covered by a cover comprised of water-resistant elastomer material.

32. A heel elevator support for stimulating circulation in the lower extremities and for preventing and managing heel pressure ulcers comprising: a rectangular cushion having a front end and a back end, a left and a right side, and a top and bottom surface, the cushion having a width from the left side to the right side approximating or less than the width of a bed, the cushion having a length from the front end to the back end approximating the length of a patient's leg from knee to Achilles tendon, the cushion having from the top surface to the bottom surface a height adequate to stimulate circulation in the lower extremities, two ramparts integral with the cushion, a first rampart located at the left side and parallel to the left side, a second rampart located at the right side and parallel to the right side, each rampart extending above the upper surface of the cushion, the support comprised of a foam material, and the support having a cover comprised of a water-resistant elastomer material, a wedge shaped supplemental support for use in conjunction with the heel elevator support, the supplemental support comprising a secondary cushion with a cover, the supplemental support having a front end and a rear end, a left side and a right side, an upper surface and a lower surface, the supplemental support having the front end in contact with the rear end of the heel elevator support, the height of upper surface at the front end of the supplemental support approximating the height of the heel elevator support, the height of the upper surface at the rear end of the supplemental support declining to the level of the lower surface of the supplemental support, the upper surface of the supplemental support sloping from the front end to the rear end, the width of the supplemental support approximating the width of the heel elevator support, the supplemental cushion comprised of a foam material, and the supplemental cushion covered by a cover comprised of water-resistant elastomer material, wherein the foam has the composition of the foam of the heel elevator support cushion.

33. A heel elevator support for stimulating circulation in the lower extremities and for preventing and managing heel pressure ulcers comprising: a rectangular cushion having a front end and a back end, a left and a right side, and a top and bottom surface, the cushion having a width from the left side to the right side approximating or less than the width of a bed, the cushion having a length from the front end to the back end approximating the length of a patient's leg from knee to Achilles tendon, the cushion having from the top surface to the bottom surface a height adequate to stimulate circulation in the lower extremities, two ramparts integral with the cushion, a first rampart located at the left side and parallel to the left side, a second rampart located at the right side and parallel to the right side, each rampart extending above the upper surface of the cushion, the support comprised of a foam material, and the support having a cover comprised of a water-resistant elastomer material, a wedge shaped supplemental support for use in conjunction with the heel elevator support, the supplemental support comprising a secondary cushion with a cover, the supplemental support having a front end and a rear end, a left side and a right side, an upper surface and a lower surface, the supplemental support having the front end in contact with the rear end of the heel elevator support, the height of upper surface at the front end of the supplemental support approximating the height of the heel elevator support, the height of the upper surface at the rear end of the supplemental support declining to the level of the lower surface of the supplemental support, the upper surface of the supplemental support sloping from the front end to the rear end, the width of the supplemental support approximating the width of the heel elevator support, the supplemental cushion comprised of a foam material, and the supplemental cushion covered by a cover comprised of water-resistant elastomer material, wherein the cover has the composition of the heel elevator support.

* * * * *